US011007101B2

(12) United States Patent
Eriksson et al.

(10) Patent No.: US 11,007,101 B2
(45) Date of Patent: May 18, 2021

(54) ADAPTIVE COMPENSATION OF WEAR IN PERSON LIFTING ASSEMBLIES

(71) Applicant: Liko Research & Development AB, Luleå (SE)

(72) Inventors: Joakim Eriksson, Luleå (SE); Mattias Andersson, Soedra Sunderbyn (SE); Erik Gustafsson, Luleå (SE)

(73) Assignee: LIKO RESEARCH & DEVELOPMENT AB, Lulea (SE)

( * ) Notice: Subject to any disclaimer, the term of this patent is extended or adjusted under 35 U.S.C. 154(b) by 536 days.

(21) Appl. No.: 15/962,428

(22) Filed: Apr. 25, 2018

(65) Prior Publication Data

US 2018/0318161 A1 Nov. 8, 2018

Related U.S. Application Data

(60) Provisional application No. 62/500,149, filed on May 2, 2017.

(51) Int. Cl.
*A61G 7/10* (2006.01)

(52) U.S. Cl.
CPC ..... *A61G 7/1046* (2013.01); *A61G 7/1051* (2013.01); *A61G 7/1073* (2013.01);
(Continued)

(58) Field of Classification Search
CPC .. A61G 7/1046; A61G 7/1049; A61G 7/1051; A61G 7/1055; A61G 7/1057;
(Continued)

(56) References Cited

U.S. PATENT DOCUMENTS 4,839,830 A * 6/1989 Amey ..... G01R 31/343 702/42
4,953,053 A * 8/1990 Pratt ..... H02H 7/085 318/465

(Continued)

FOREIGN PATENT DOCUMENTS

CN 103701392 B 1/2016
CN 103888019 B 9/2016

*Primary Examiner* — Robert G Santos
(74) *Attorney, Agent, or Firm* — Dinsmore & Shohl LLP

(57) ABSTRACT

A motive system for a patient lifting assembly, a patient lifting assembly and a method of operating a patient lifting assembly. The motive system includes an electric motor, numerous sensors and an adaptive control unit cooperative with one another so that a memory and processor that are part of the control unit that can respectively store and execute a computer readable and executable instruction set. By comparing collected data from the sensors during operation of the motor to corresponding reference values associated with one or more motor operational parameters—such as accumulated motor wear over time or differences in operating temperature of the motor—the system can selectively adjust the maximum amount of current available for use by the motor. In this way, changes in motor efficiencies that arise with these parametric changes can be taken into consideration when determining an upper limit on how much electrical current may be delivered to the motor for a given load.

25 Claims, 6 Drawing Sheets

(52) U.S. Cl.
CPC ..... *A61G 7/1015* (2013.01); *A61G 7/1017* (2013.01); *A61G 7/1042* (2013.01); *A61G 7/1059* (2013.01); *A61G 7/1061* (2013.01); *A61G 7/1067* (2013.01); *A61G 2203/30* (2013.01); *A61G 2203/46* (2013.01)

(58) Field of Classification Search
CPC .. A61G 7/1059; A61G 7/1061; A61G 7/1065; A61G 7/1013; A61G 7/1017; A61G 7/1019; A61G 2200/34
USPC ..... 5/86.1, 81.1 R, 83.1, 85.1, 87.1, 89.1
See application file for complete search history.

(56) References Cited

U.S. PATENT DOCUMENTS 5,189,350 A * 2/1993 Mallett ..... G01D 1/14 318/434
5,662,311 A * 9/1997 Waedekin ..... B66C 13/105 254/270
5,726,911 A * 3/1998 Canada ..... G01R 31/343 318/434
5,852,351 A * 12/1998 Canada ..... G01R 31/343 318/490
5,883,344 A 3/1999 Colby et al.
5,917,428 A * 6/1999 Discenzo ..... G01R 31/343 340/870.01
5,973,473 A 10/1999 Anderson et al.
6,041,287 A * 3/2000 Dister ..... B60L 3/0023 702/182
6,297,742 B1 * 10/2001 Canada ..... G01R 31/343 318/490
7,021,427 B2 * 4/2006 Skovgaard ..... A61G 7/1015 187/281
7,311,297 B1 * 12/2007 Bradshaw ..... B66D 3/18 254/271
8,085,146 B2 * 12/2011 Rees ..... A61G 7/018 340/540
8,279,565 B2 * 10/2012 Hall ..... H02H 7/0816 361/31
8,442,692 B2 5/2013 Okitsu et al.
8,474,794 B2 * 7/2013 Liljedahl ..... A61G 7/1063 254/120
8,538,710 B2 * 9/2013 Todd ..... G16H 40/63 702/63
8,831,832 B2 9/2014 Hoshi et al.
8,910,325 B2 12/2014 Faucher et al.
9,242,576 B1 1/2016 Turnbull et al.
9,408,765 B2 * 8/2016 Andersson ..... A61G 7/1042
9,527,699 B2 * 12/2016 Liljedahl ..... B66C 23/46
9,561,147 B2 * 2/2017 Todd ..... G06F 19/00
9,875,582 B2 * 1/2018 Bolin ..... G07C 3/06
10,076,459 B2 * 9/2018 Todd ..... A61G 7/1065
10,322,046 B2 * 6/2019 Liljedahl ..... A61G 7/10
10,376,434 B2 * 8/2019 Andersson ..... A61G 7/1065
10,420,690 B2 * 9/2019 Dixon ..... A61G 7/1061
10,478,360 B2 * 11/2019 Andersson ..... A61G 7/10
10,478,361 B2 * 11/2019 Harmeyer ..... A61G 7/1042
10,526,178 B2 * 1/2020 Huang ..... B66D 1/12
10,596,052 B2 * 3/2020 Andersson ..... A61G 7/10
10,610,431 B2 * 4/2020 Andersson ..... A61G 7/1051
10,780,004 B2 * 9/2020 Liljedahl ..... B66C 23/62
2004/0118639 A1 * 6/2004 Skovgaard ..... A61G 7/1015 187/296
2009/0102667 A1 * 4/2009 Rees ..... A61G 7/018 340/573.1
2010/0214709 A1 * 8/2010 Hall ..... H02H 7/0816 361/93.9
2010/0224841 A1 9/2010 Liljedahl
2011/0082655 A1 * 4/2011 Todd ..... A61G 7/10 702/63
2013/0038263 A1 * 2/2013 Faucher ..... A61G 7/1065 318/434
2013/0168622 A1 * 7/2013 Liljedahl ..... A61G 7/1063 254/8 R
2013/0339047 A1 * 12/2013 Todd ..... G06Q 30/018 705/2
2014/0013503 A1 * 1/2014 Dixon ..... G16H 40/63 5/85.1
2014/0020175 A1 * 1/2014 Dixon ..... A61G 7/1017 5/85.1
2014/0055122 A1 * 2/2014 Todd ..... A61G 7/1065 324/71.1
2014/0075669 A1 * 3/2014 Andersson ..... F16D 13/12 5/85.1
2015/0284229 A1 10/2015 Hall et al.
2016/0254767 A1 9/2016 Nagaraj et al.
2016/0313377 A1 * 10/2016 Bolin ..... G07C 3/04
2016/0338895 A1 * 11/2016 Andersson ..... F16D 13/12
2017/0000672 A1 * 1/2017 Andersson ..... A61G 7/1046
2017/0000673 A1 * 1/2017 Harmeyer ..... A61G 7/1017
2017/0027794 A1 * 2/2017 Andersson ..... G01G 19/44
2017/0071807 A1 * 3/2017 Liljedahl ..... B66C 13/40
2018/0318161 A1 * 11/2018 Eriksson ..... A61G 7/1051
2019/0077642 A1 * 3/2019 Huang ..... H02H 7/085
2019/0134234 A1 * 5/2019 Lee ..... A61K 51/121
2019/0247255 A1 * 8/2019 Liljedahl ..... A61G 7/1063
2020/0030171 A1 * 1/2020 Andersson ..... A61G 7/1051

* cited by examiner

ADAPTIVE COMPENSATION OF WEAR IN PERSON LIFTING ASSEMBLIES

BACKGROUND

The present specification generally relates to systems used in person lifting devices, such as mobile lifts or overhead lifts, and more particularly to adjustment of the operation of a motor within such systems that takes into consideration variations in one or more motor operational parameters.

Person lifting devices, typically in the form of a patient lifting assembly, may be used in home care settings, hospitals and related health care facilities to reposition or otherwise move a person in need of ambulatory assistance. Such assemblies are typically configured as either mobile or overhead variants. Regardless of the configuration, such devices include a sling or related support member that is cooperative with an electric motor (such as a DC motor) or similar mechanism so that a person positioned within the sling may be raised, lowered or otherwise repositioned or transported. In one conventional form, the motor is further coupled to a flexible strap, rigid arm, worm gear or other known actuator to form a lift unit that when secured to a frame or related support may provide patient lift and support functions. Typically, the lift unit defines a self-locking feature that—while valuable for providing fail-safe operation—tends to operate with relatively low efficiency.

The amount of electrical current used by the motor of patient lifting devices may vary in proportion to the load, which in a common form is based on the weight of the person being lifted. Such current is typically referred to as the operating current. Likewise, a maximum permissible amount of motor operating current is set to correspond to the maximum load rating for the patient lifting device; this is called the current limit or maximum current limit. The maximum load rating for patient lifting devices is commonly established by a governmental body or related regulating authority, and is based on the structural or related mechanical load-bearing limits of the various components that make up the patient lifting device. The authors of the present disclosure have determined that the motor—as well as other components—wear over time, and that such wear causes a variation in current consumption by the motor relative to its as-manufactured condition. They have furthermore determined that with particular regard to DC motors, increases in both operating temperature and the accumulated usage that leads to such such wear (at least up to a point for both) tend to equate to increases in such efficiency in that a motor under such conditions will produce the same torque at a lower amount of current consumption. Moreover, the authors of the present disclosure have determined that toward its end-of-life (EOL) operation, the motor may revert back and become less efficient, which in turn leads to operating conditions where the motor requires more current to lift the same load.

These increases in operational efficiency associated with motor use and temperature variations can lead to the motor actually being capable of lifting more than the permissible maximum load rating. That is to say, it is possible for the motor to consume more current than that permitted by the maximum current limit that is programmed into a control system that is used to regulate—among other things—motor operation. This is problematic in that even though the motor may be capable of provide lifting and related patient moving functions for an excessively heavy load, other portions of the patient lifting device are not. Accordingly, motor operation under such overloaded circumstances could—notwithstanding its excess capacity due to the efficiency gains attendant to increases in temperature or accumulated usage—lead to mechanical or structural failure of one or more of the other patient lifting device components. Contrarily, decreases in motor operational efficiency in EOL conditions are likewise problematic in that the control system may shut down the motor at a predetermined maximum current limit that the control system correlates to exceeding the maximum load rating notwithstanding that the actual load being lifted is within the acceptable limits established by such rating. That is, the control system could construe a given operating current at EOL as corresponding to a load that exceeds the maximum load that the patient lifting device is rated for, which in turn will cause the control system to not allow the motor to operate, leading to inadvertent shutdown of the patient lifting device.

SUMMARY

According to one embodiment, a motive system for a patient lifting assembly includes an electric motor, numerous sensors and an adaptive electronic control unit (which is also referred to herein more simply as a control unit). The sensors include at least a temperature sensor, a current sensor and an accumulated use sensor, while the control unit is signally cooperative with the motor and the sensors. In this way, a processor and non-transient memory that contains a computer readable and executable instruction set can use data collected from the sensors that is acquired during operation of the motor to compare the collected data to known reference values that modify the as-manufactured motor performance criteria with one or both of temperature- and accumulated usage-based compensation factors, and then selectively adjust a limit on maximum permissible current being sent to the motor. This ensures that the amount of current being delivered to the motor (such as to provide motive power to a person lifting assembly) can be maintained without interruption under high load conditions, while also ensuring that the motor does not operate upon a load that is outside the permissible bounds of the structure to which it is attached.

According to another embodiment, a patient lifting assembly includes a motive system, a base and a patient-receiving device. The motive system is coupled to the base and the one or more receiving device such that by the operation of its motor and mechanically-coupled equipment, they move the patient who is loaded into the receiving device. The control unit can cooperate with the sensors such that operating current, temperature and accumulated use data acquired during motor operation can be compared to corresponding reference values that are based on the as-manufactured motor performance criteria that have been modified by one or both of corresponding temperature and accumulated usage compensation factors. This comparison may then be used to adaptively vary the amount of maximum permissible electrical current being sent to the motor to compensate for one or both of such temperature and wear variations.

According to yet another embodiment, a method for operating a patient lifting assembly includes moving a patient that is disposed within the assembly through the operation an electric motor that provides motive power to the assembly, determining an operational parameter made up of a motor temperature and a motor accumulated usage, comparing the operational parameter to a corresponding reference value to determine whether a difference exists, and adjusting a maximum current limit available to the motor during a period of operation thereof based on such difference. Within the present context, such difference may be in the form of an adjustment threshold that indicates that a correlation between the as-manufactured work required and an actual work required is no longer present during operation of the motor. This in turn means that one or more suitable compensation factors associated with the operational parameter may be applied—such as through an adaptive control unit—to make the corresponding current limit adjustment.

These and additional features provided by the embodiments of the present disclosure will be more fully understood in view of the following detailed description, in conjunction with the accompanying drawings to provide a framework for understanding the nature and character of the claimed subject matter.

BRIEF DESCRIPTION OF THE DRAWINGS

The following detailed description of the various embodiments can be best understood when read in conjunction with the following drawings, where like structure is indicated with like reference numerals and in which the various components of the drawings are not necessarily illustrated to scale.

DETAILED DESCRIPTION

The embodiments disclosed herein include adaptively adjusting the operation of a motor used in a patient lifting assembly based on changes to motor usage and temperature parameters that provide indicia of changes in operational efficiency of the motor. By way of example and not limitation, mapping the current consumption of a population of similar motors over time and as a function of such variables as the motor temperature and one or more of the number of starts, the total operation time and current permits the behavior of the motor to be determined. Such behavior includes, without limitation, how the current consumption of the motor varies over its operational lifetime. As such, this mapping may be incorporated into a control scheme that can be used to adjust the maximum amount of motor operating current (that is to say, the maximum current limit of the motor) to ensure that the patient lift assembly is efficiently lifting loads within its maximum load rating over the service life of the patient lift system.

Figure 1:
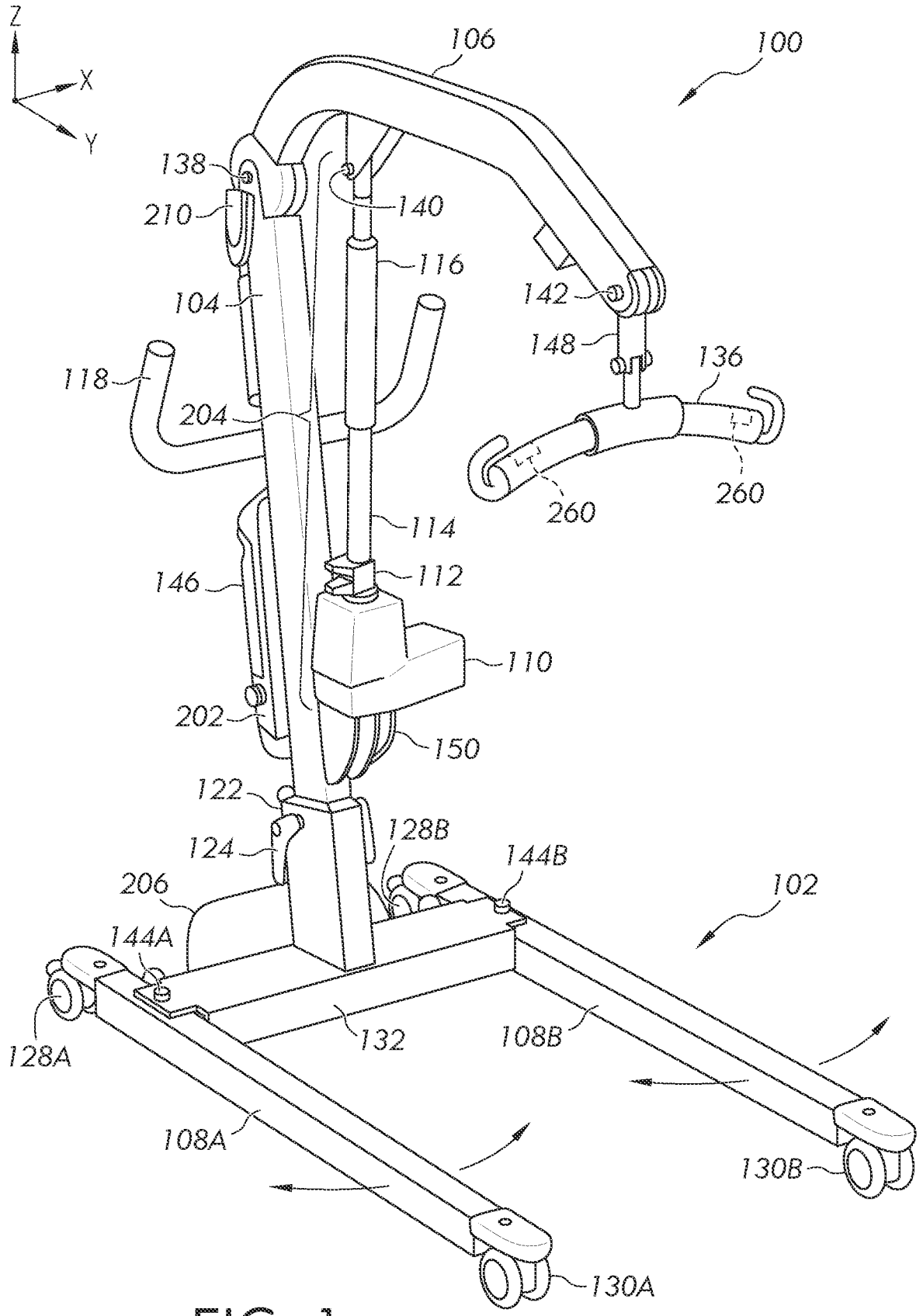
FIG. 1 schematically depicts a perspective view of an embodiment of a mobile lifting assembly in accordance with one or more embodiments shown or described herein.

Referring first to FIG. 1, one embodiment of a mobile person lifting assembly 100 with its lift control system 200 according to the present disclosure is schematically illustrated. Within the present disclosure, the terms "lifting device" and "lifting assembly" and their variants—whether used in conjunction with the terms "person" in general and "patient" in particular—are deemed to be interchangeable unless the context directs otherwise. In one embodiment, the person lifting assembly 100 may generally include a base 102, a lift mast 104 and a lift arm 106. The base may include a pair of base legs 108A, 108B which are pivotally attached to a cross support 132 at base leg pivots 144A, 144B such that the base legs 108A, 108B may be pivotally adjusted with respect to the lift mast 104 as indicated by the arrows. The base legs 108A, 108B may be pivoted with a base actuator 206 which is mechanically coupled to both base legs 108A, 108B with base motor linkages (not shown). In one embodiment, the base actuator 206 may include a linear actuator such as a motor (not shown) mechanically coupled to telescoping threaded rods connected to the base motor linkages such that, when an armature of the motor 110 is rotated, one of the threaded rods is extended or retracted relative to the other. For example, in the configuration shown, when the rods are extended, the base legs 108A and 108B are pivoted towards one another and, when the rods are retracted, the base legs 108A and 108B are pivoted away from one another. The base legs 108A, 108B may additionally include a pair of front casters 130A, 130B and a pair of rear casters 128A, 128B the latter of which may include brakes (not shown).

In embodiments, the base 102 may further include a mast support 122 disposed on the cross support 132. In one embodiment, the mast support 122 may be a rectangular receptacle configured to receive the lift mast 104 of the lifting assembly 100. For example, a first end of the lift mast 104 may be adjustably received in the mast support 122 and secured with a pin, threaded fastener, or a similar fastener coupled to the adjustment handle 124. The pin or threaded fastener extends through the mast support 122 and into one or more corresponding adjustment holes (not shown) on the lift mast 104. Accordingly, it will be understood that the position of the lift mast 104 may be adjusted vertically (for example, along the Z-axis on the Cartesian coordinate system shown) with respect to the base 102 by repositioning the lift mast 104 in the mast support 122. The lift mast 104 may further include at least one handle 118 coupled to the lift mast 104. The handle 118 may provide an operator with a grip for moving the person lifting assembly 100 on the casters 128A, 128B, 130A and 130B. Accordingly, it should be understood that, in at least one embodiment, the person lifting assembly 100 is mobile. While the term "lift" and its variants is conventionally used to describe the movement of a person or other weight that is situated within or otherwise being transported in a vertically up and down direction along the Z-axis of a conventional Cartesian coordinate system, the use of such term within the present context is meant to include all such movement of such person, weight or load in any or all of the principle axes. As such, substantially horizontal movement by the device, system or assembly disclosed herein of such person, weight or load is understood to fall within the definition of the term, as are all other terms associated with such movement or transport, and all such variants are deemed to be used interchangeably unless the context clearly dictates otherwise.

The person lifting assembly 100 may further include a lift arm 106 which is pivotally coupled to the lift mast 104 at the lift arm pivot 138 at a second end of the lift mast such that the lift arm 106 may be pivoted (e.g., raised and lowered) with respect to the base 102. While the lift arm 106 is presently shown in the fully raised position, it will be appreciated that it can also be extended to a fully lowered position (not shown). The lift arm 106 may include at least one lift accessory 136 coupled to the lift arm 106 with an accessory coupling 148 such that the lift accessory 136 is raised or lowered with the lift arm 106. The accessory coupling 148 is pivotally attached to the lift arm 106 at an end of the lift arm 106 opposite the lift arm pivot 138. In one embodiment, the accessory coupling 148 is pivotally attached to the lift arm 106 at attachment pivot 142 such that the lift accessory 136 (a sling bar in the illustrated embodiment) may be pivoted with respect to the lift arm 106. However, it should be understood that, in other embodiments, the accessory coupling 148 may be fixedly attached to the lift arm 106 or that the lift accessory 136 may be directly coupled to the lift arm 106 without the use of an accessory coupling 148.

In the embodiments described herein, the person lifting assembly 100 is mechanized such that raising and lowering the lift arm 106 with respect to the base 102 may be achieved using a lift actuator 204. In the embodiments shown, the lift actuator 204 is a linear actuator which includes a motor 110 mechanically coupled to an actuator arm 114. Within the present disclosure, the term "actuator" may be an assembly that includes such motor 110, or may be an intermediate connecting mechanism or related discreet component that is responsive to the operation of the motor 110 in order to effect one or both of translational or rotational movement of one or more components mechanically or signally coupled thereto; such usage will be apparent from the context. More specifically, the motor 110 may include a rotating armature (not shown), while the actuator arm 114 may include one or more threaded rods coupled to the armature such that when the armature is rotated, the threaded rods are extended or retracted relative to one another to facilitate comparable movement of the actuator arm 114. In one form, the motor 110 is a brushed DC motor that provides self-locking attributes (such as through its cooperation with a worm gear) so that upon a loss of power, the motor 110 and engaged worm gear do not drop the load that is situated in the person lifting assembly 100. In one form, the lift actuator 204 may further include a support tube 116 disposed over the actuator arm 114. The support tube 116 provides lateral support (for example, in one or both of the X and Y directions of the Cartesian coordinate system shown) to the actuator arm 114 as the actuator arm 114 is extended.

The lift actuator 204 is fixedly mounted on the lift mast 104 and pivotally coupled to the lift arm 106. In particular, the lift mast 104 includes a bracket 150 to which the motor 110 of the lift actuator 204 is attached while the actuator arm 114 is pivotally coupled to the lift arm 106 at the actuator pivot 140. Accordingly, it should be understood that, by operation of the motor 110, the actuator arm 114 is extended or retracted thereby raising or lowering the lift arm 106 relative to the base 102. In one embodiment, the lift actuator 204 may further include an emergency release 112 that facilitates the manual retraction of the actuator arm 114 in the event of a mechanical or electrical malfunction of the lift actuator 204. While the embodiments described herein refer to the lift actuator 204 as comprising a motor 110 and an actuator arm 114, it will be understood that the actuator may have various other configurations and may include a hydraulic or pneumatic actuator comprising a mechanical pump, compressor or related device.

An electronic control unit 202 facilitates actuation and control of both the lift actuator 204 and the base actuator 206. The electronic control unit 202 may include a battery 146 or related electrical power source, and is operable to receive an input from an operator via wired or wireless device such as a wired pendant or the like that may be separate from or integrated into the electronic control unit 202, while in another form may be a wireless hand control, wireless diagnostic monitor, wireless diagnostic control or the like. Based on the input received from the device, the electronic control unit 202 is programmed to adjust the position of one or more of the lift arm 106 and the base legs 108A, 108B by sending electric control signals to one or more of the lift actuator 204 and the base actuator 206. Additional equipment (not shown) such as a display may be signally coupled the electronic control unit 202 to show lift data that can be used to provide feedback relating to such adjusted position to an operator of the lifting assembly 100. In operation, the electronic control unit 202 provides signal-based control such that the person (not shown) being moved by the person lifting assembly 100 may be seated or otherwise placed within a harness, sling or related receiving device (not shown) that is attached to the lift arm 106 through the lift accessory 136. More particularly, such control includes sending a suitable signal to the motor 110 of the lift actuator 204 such that it may in turn manipulate the position of one or more of the lift mast 104, the lift arm 106 and actuator arm 114 to pay out or take up the lift accessory 136 and accessory coupling 148.

Figure 2:
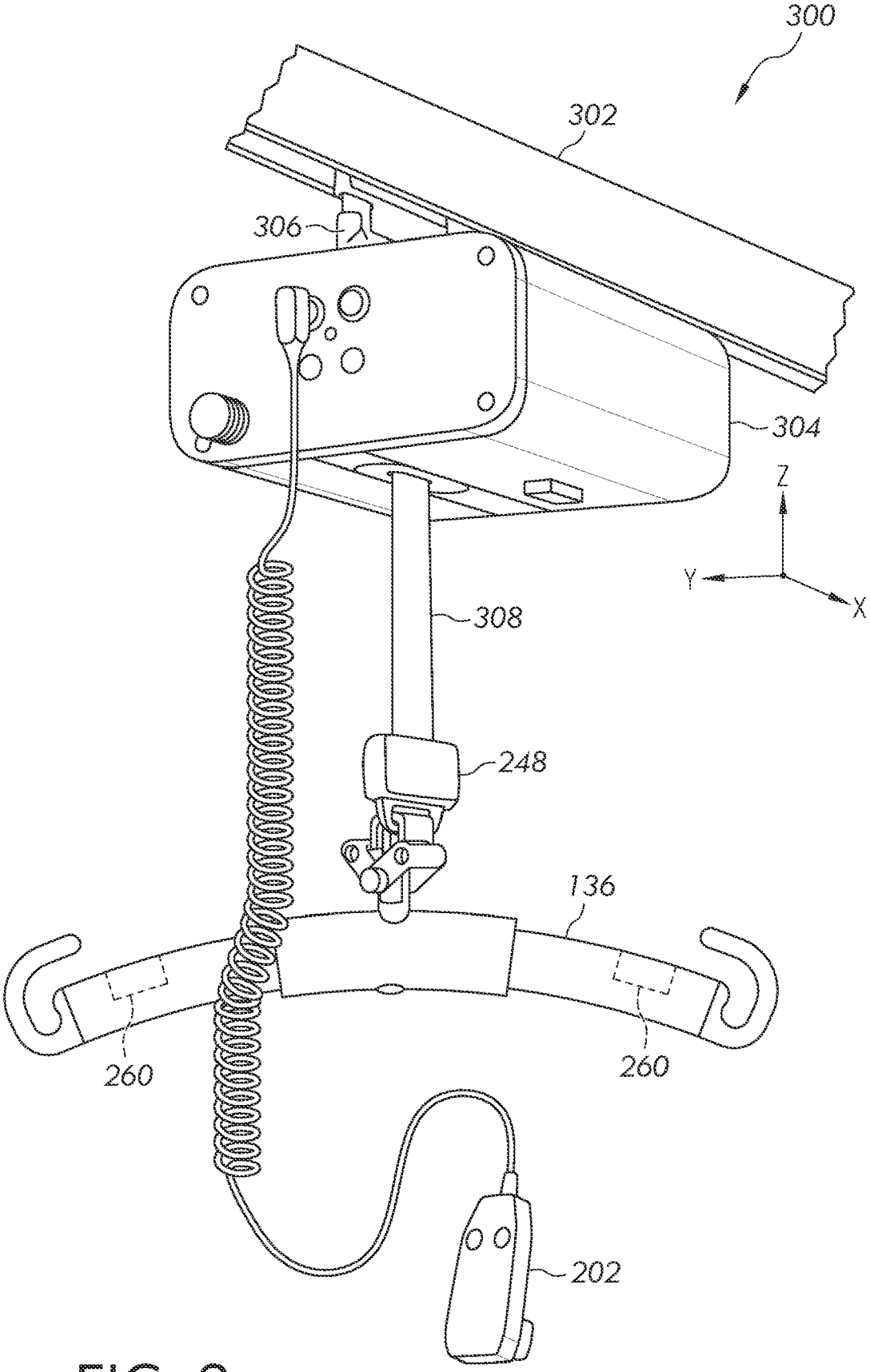
FIG. 2 schematically depicts a perspective view of an embodiment of an overhead lifting assembly in accordance with one or more embodiments shown or described herein.

Referring next to FIG. 2, another embodiment of a person lifting assembly 300 is schematically depicted. In this embodiment, the person lifting assembly 300 is in a rail-mounted overhead configuration. The person lifting assembly 300 generally includes a lift unit 304 which is slidably coupled to a rail 302 with a carriage 306. The lift unit 304 may be used to support, lift or otherwise transport a patient with a lifting strap 308 which is coupled to a lift actuator, in this case a motor, contained within the lift unit 304. The lift actuator (which includes a motor, not shown) facilitates paying-out or taking-up the lifting strap 308 from the lift unit 304 thereby raising and lowering a patient attached to the lifting strap 308. For example, an end of the lifting strap 308 may include an accessory coupling 248 to which the lift accessory 136 (i.e., a sling bar in the embodiment shown) may be attached. In the embodiments described herein, the lift unit 304 further includes a battery which is housed in the lift unit 304 and electrically coupled to the lift actuator thereby providing power to the lift actuator 333. Nevertheless, it will be understood that in other embodiments the lift unit 304 may be constructed without the battery, such as when the lift actuator is directly wired to a power source. The person lifting assembly 300 further includes the electronic control unit 202 as previously discussed.

As with the person lifting assembly 100 discussed previously, the person (not shown) being moved by the person lifting assembly 300 may be seated or otherwise placed within a harness, sling or related receiving device (not shown) that is attached to the lifting strap 308 through the lift accessory 136. The lift unit 304 may be actuated with the electronic control unit 202 to pay out or take up the lifting strap 308 from the lift unit 304. In the embodiment shown, the electronic control unit 202 is directly wired to the lift unit 304. However, it should be understood that, in other embodiments, the electronic control unit 202 may be wirelessly coupled to the lift unit 304 to facilitate remote actuation of the lift unit 304.

The lift unit 304 is mechanically coupled to a carriage 306 which facilitates slidably positioning the lift unit 304 along rail 302. The lift unit 304 includes a connection rail (not shown) which is mounted to the top surface of the lift unit 304. The carriage 306 may be secured to the connection rail with a fastener (not shown) that extends transversely through openings in the carriage 306 and a corresponding opening in the connection rail. A carriage body includes a plurality of rotatably-mounted support wheels (not shown) positioned on axles which extend transversely through the carriage body for rolling movement within the rail. In one form, the support wheels are passive in that they are not actively driven with the motor. Likewise, the lift unit 304 is manually traversed along the rail 302. However, in alternative embodiments (not shown), the support wheels may be actively driven such as when the support wheels are coupled to a motor or a similar mechanism.

The person lifting assembly 100 of FIG. 1 can in one form be defined by known geometrical data of the lift arm 106. In such circumstance, the location of the arm 106 may be determined (through, for example, potentiometer or other sensor measurement) in order to calculate lifting or related forces. Relatedly, the ceiling-based overhead person lifting assembly 300 of FIG. 2 with its strap-based operation that is connected to a winding drum of the lift strap may involve differing loads depending on the number of windings of the drum (where such load may be at the top or at the bottom), as well as knowing that the mechanics of the transmission, drum and other components have an efficiency of their own. Even so, potentiometer-based measurements may be correlated to how many windings there are on the drum, which in turn can be used in conjunction with a known radius of force on the drum (i.e., torque) to help define the load that is hanging in the strap.

Figure 3:
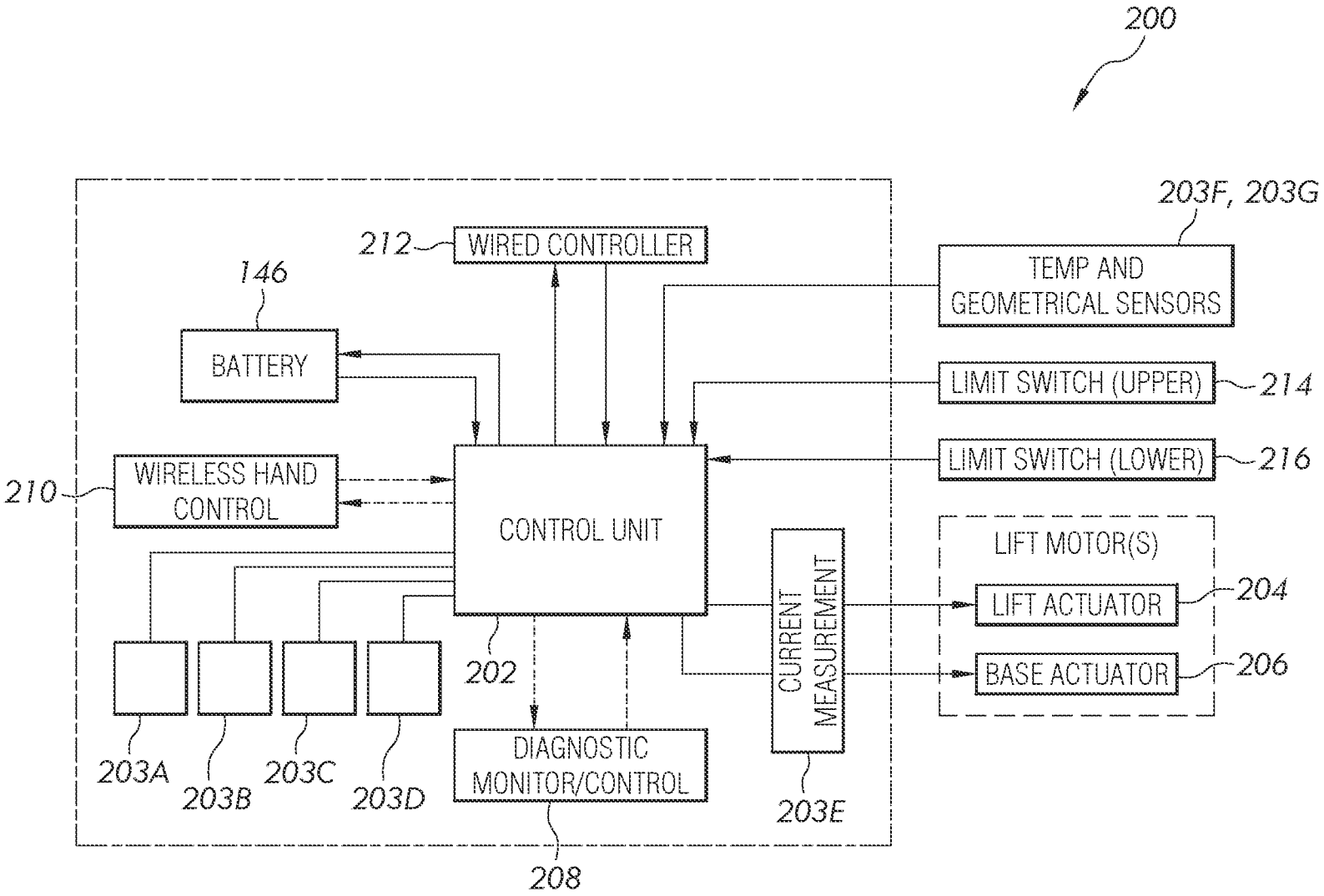
FIG. 3 schematically depicts a block diagram of a lift control system that makes up a portion the lifting assembly of FIG. 1 or 2.

Referring next FIG. 3, a block diagram showing the interaction of the various components of the lift control system 200 is shown. As can be seen, the electronic control unit 202 performs the central function of aggregating input and directing output to the various other components. In particular, control unit 202 may be implemented as part of a larger automated data processing equipment such as that associated with a digital computer. In such configuration, control unit 202 may include an input, an output, a processing unit (often referred to as a central processing unit (CPU)) and memory that can temporarily or permanently store a code, program, algorithm, lookup table data or related computer readable and executable information or instructions which—when executed by the CPU—automatically determine at least one characteristic of the motor 110 as it is subjected to different weights of the load, as well differences in motor 110 operating temperature and amount of accumulated use or related indicia of wear, both as will be discussed in more detail elsewhere in this disclosure. This automation may take place through the program being performed, run or otherwise conducted on the control unit 202. In one form, a data-containing portion of the memory (also called working memory) is referred to as random access memory (RAM), while an instruction-containing portion of the memory (also called permanent memory) is referred to as read only memory (ROM). A data bus or related set of wires and associated circuitry forms a suitable data communication path that can interconnect the input, output, CPU and memory, as well as any peripheral equipment in such a way as to permit the system 200 to operate as an integrated whole. In this configuration, control unit 202 is referred to as having a von Neumann architecture, and is configured to perform the specific automated steps outlined in this disclosure. In such circumstances, control unit 202 may become a particularly-adapted computer that employs the salient features of such an architecture in order to perform at least some of the data acquisition, manipulation or related computational functions disclosed herein. It will be appreciated by those skilled in the art that computer-executable instructions that embody the calculations discussed elsewhere in this disclosure can be placed within an appropriate location (such as the aforementioned memory) in order to achieve the objectives set forth in the present disclosure, and that at least some of the components that make up the control unit 202 may be embodied on a printed circuit board (PCB) or the like.

In one form, the memory of the control unit 202 may contain one or more lookup tables or related data structure that may in turn be embedded or otherwise contained within any suitable machine-accessible medium, such as a preprogrammed chip or memory device, flash memory, hard disk drive, CD, DVD, floppy disk or related non-transitory structure (none of which are shown). As will be discussed in more detail below in conjunction with FIG. 4, at least some of the data contained in such a lookup table may be pre-loaded into the memory of the control unit 202 using information provided by, for example, the manufacturer of the motor 110. In embodiments, data used in such table or tables may be indexed to take into consideration the tare weight associated with various lift accessories (such as the previously-discussed lift accessory 136) and ancillary equipment as a way to have the weight or load better reflect that of the patient or person being lifted. Likewise, the control unit 202 may be programmed to respond to data stored within the one or more lookup tables so that it may then make a parametric adjustment of the maximum current limit that corresponds to the maximum load rating of the motor 110 and/or the person lifting assembly 100, 300. Examples of operational parameters that may be stored in the lookup table or tables that impact a change in motor 110 current consumption may include temperature and accumulated usage where the latter may further include wear-in factors relating to total operating time (that is to say, total accumulated usage), total load lifted (that is to say, total current through the system which may, for example, be measured in ampere hours), number of cold starts, or the like.

Significantly, the maximum current limit for a particular motor operational condition is being adjusted rather than adjusting the amount of operating current being input to the motor 110 for such condition. In this way, it is possible to keep the motor 110 within the maximum load rating for the person lifting assemblies 100, 300, regardless of changes in its operational efficiency resulting from the impact of temperature or accumulated usage experienced by the motor 110. By way of example and not limitation, a motor 110 that is yet to experience a wear-in period of operation or elevated temperature may take 10 amps to lift a 200 kg load, but after a certain amount of accumulated usage (such as that associated with numerous hours of operation) may take 5 amps to lift the same 200 kg load. Moreover, as will be discussed in conjunction with FIG. 6, it may be that the same motor 110, after an even greater amount of accumulated usage (such as that associated with its projected EOL number of hours) may take 8 amps to lift that same 200 kg load. Thus, if the maximum load rating of the lift is 200 kg, and the control unit 202 is programmed such that lifting 200 kg requires 10 amps (that is, the maximum current limit is 10 amps such that the motor 110 will shut down when it exceeds 10 amps as the maximum working load of the lifting assembly is exceeded), when accumulated usage causes the motor to wear-in, the motor 110 initially becomes more efficient such that it can actually lift more than 200 kg without exceeding the 10 amp current draw limit that is being monitored by the control unit 202. Under these circumstances, the motor 110 is actually able to lift more than the maximum working load without exceeding the maximum current limit. Contrarily, when the motor 110 is approaching an accumulated usage that corresponds to its EOL (such as that depicted at the rightmost portion of a bathtub-shaped correlation of an X-Y plot as shown and described in conjunction with FIG. 6), the motor 110 may experience an elevated level of current draw needs. Under these EOL conditions, the motor 110 may exceed the maximum current limit when lifting loads that are less than the maximum working load of the lifting assemblies 100, 300. That is, the motor 110 is operating with reduced efficiency that results in a decrease in lifting capacity for a fixed maximum current limit. By using a working knowledge of how the current draw of the motor 110 changes with time (that is to say, accumulated usage), the control unit 202 of the present disclosure adaptively adjusts the maximum current limit to prevent the motor 110 from lifting a load that exceeds the maximum load-bearing capability of the various components that make up the person lifting assemblies 100, 300. Relatedly, the control unit 202 maintains the lifting capacity of such assemblies as motor 110 efficiencies begin to decline when the amount of time of motor 110 operation approaches the motor 110 EOL. Likewise, efficiency increases on motor 110 operation associated with higher temperature environments (at least up to a temperature lower than that where damage may occur to the motor 110, lubricants or other ancillary parts thereof) may be taken into consideration by the control unit 202 in adaptively adjusting the maximum current limit in ways that mimic the increases in motor 110 efficiency that result from the wear-in portion of the accumulated usage. Thus, by knowing the dynamic temperature- and wear-related characteristics of the motor 110, the amount of current being delivered can be maintained at the required value (plus a slight operating margin) without running afoul of the maximum load rating of the person lifting assemblies 100, 300.

Thus, in operational circumstances when at least one of the compared temperature and accumulated use data is within an adjustment threshold, the electronic control unit 202 can adjust the maximum power (specifically, current) consumption permitted by the motor 110 in response to a variation in its operational characteristics that accompany wear and changes in operating temperature. In this way, such adjustment thresholds provide indicia that the amount of actual work required by the motor 110 (as measured by the amount of electrical current needed) deviates from that required of the motor 110 in its reference condition, which by virtue of one or more suitable compensation factors already reflects changes relative to a corresponding as-manufactured operational parameter. Thus, the known phenomenon of motor 110 characteristic change over time can be extended to adaptively vary the motor 110 maximum current limit as a way to compensate for such changes. Accordingly, the adjustment threshold is understood to be a quantified (or quantifiable) measure of how the current needs of the motor 110 in its as-manufactured condition differ over such needs in a particular moment in time with known amounts of such temperature and accumulated use. While an example of when such an adjustment threshold is present that in turn would be used by the control unit 202 as a way to adjust the maximum current limit for motor 110 will be discussed in more detail in conjunction with FIGS. 4 through 6, it will be appreciated that the precise values of these parameters may vary depending on the size, power rating and other qualities unique to a given motor 110 configuration, and that all such variations are deemed to be within the scope of the present disclosure.

Within the present context, terms related to accumulated use pertain to wear-in or burn-in adjustments, while terms related to run data and related cycles pertain to temperature-based adjustments. Taken together, the wear-related accumulated use data, the temperature rise-related run data and load data (which in turn may depend not just on individual patient weight, but also on geometrical considerations associated with the particular construction or configuration of the assemblies 100, 300) may be utilized by the electronic control unit 202 to help establish algorithmic- or data-based approaches to determining the current limit for the motor 110 of the patient lifting assemblies 100, 300. With particular regard to the accumulated use, a real-time clock (RTC) or related oscillator-based timer may be used to measure the run time of motor 110. Moreover, such clock may be used to measure the current so that indicia of electric charge (for example, ampere-hours) may be provided and used as a basis for an accurate determination of power used by the motor 110. Such measures can then be embodied in one of the previously-mentioned lookup tables for subsequent use by the electronic control unit 202 to correlate such accumulated use to motor 110 wear. With particular regard to the run data that gives the actual temperature rise associated with an actual lift cycle, measuring actual current (which is directly proportion to the load) and time may be correlated to temperature rise through the rate of change (i.e., derivative) in that knowing that a certain rate of change will result in a certain temperature increase. In one form, temperature sensors (such as sensors 203F as discussed in conjunction with FIG. 3 below) may be used to indicate the surrounding ambient environment temperature in order to have a quantifiable thermal frame of reference. With particular regard to the patient lift data that generates geometric data, geometrical data sensors 203G (also as discussed in conjunction with FIG. 3 below) such as a potentiometer may be used to help recalibrate torques to actual weights being imparted to the lift. Given these factors, a general form of an equation, formula or related algorithm may be represented as follows:

$$I_{limit}=f(\text{accumulated use}+\text{temperature rise}+\text{load}) \quad (1)$$

where parameters such as current and time are continuously measured for use in either table or algorithmic form such that the processor of the control unit 202 may determine corrections commensurate with changes in motor 110 operational efficiency. It will be appreciated that any such adjustments to this generalized current limit equation may need an initial calibration or tare weight values in order to correctly set the differentiators (such as those associated with individual patient weights, manufacturing variances or the like).

Figure 4:
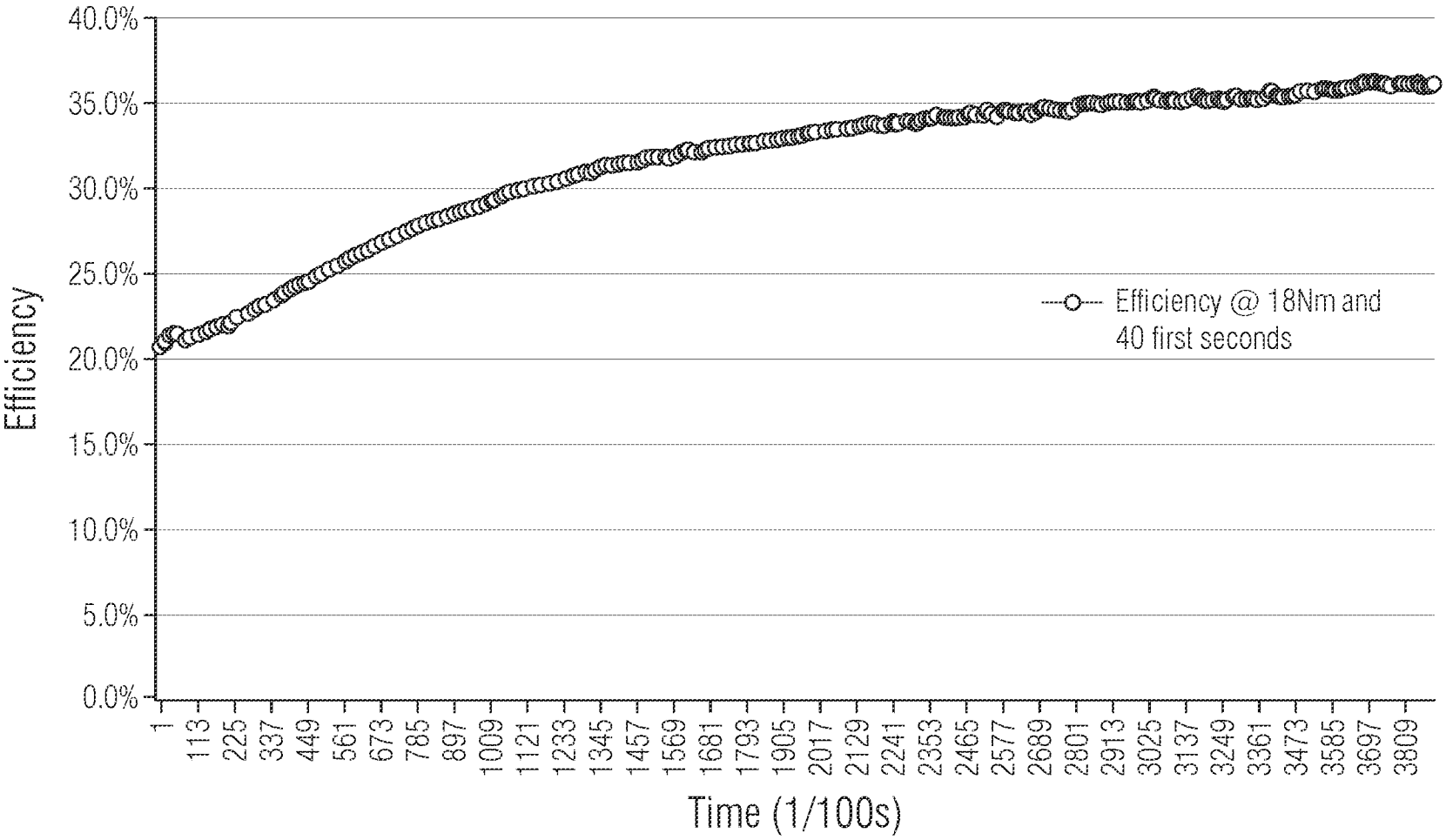
FIG. 4 is a plot of the changes in motor operational efficiency over time based on experimental testing of a motor used in the assemblies of FIG. 1 or 2.
Figure 5:
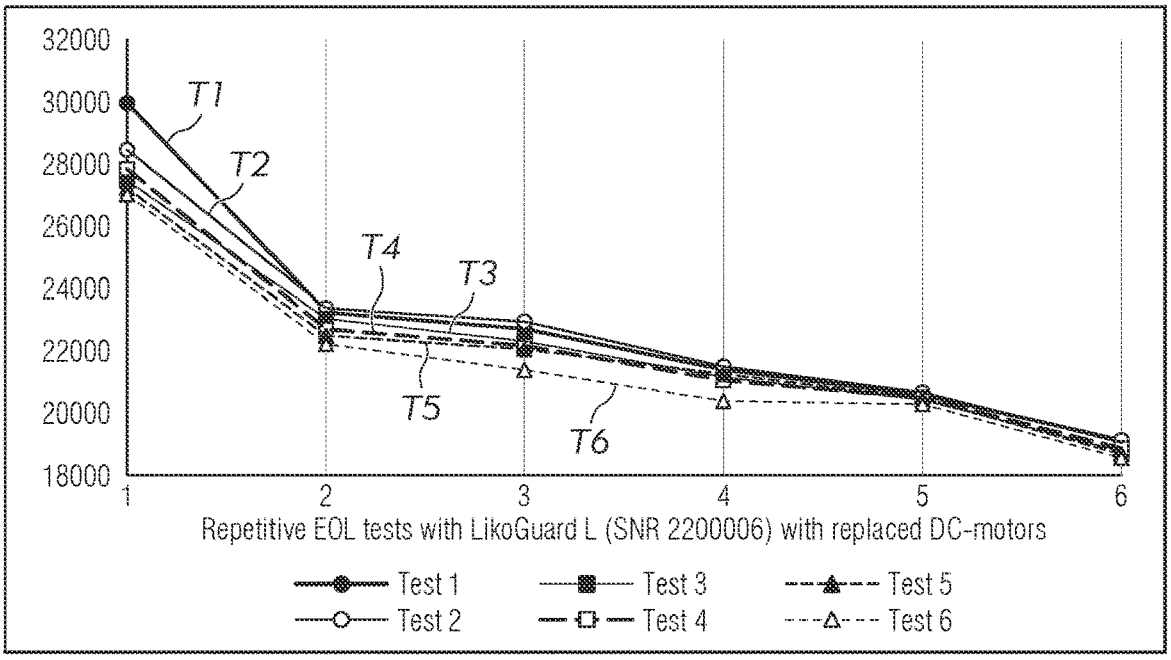
FIG. 5 is a plot of the changes in motor current draw over numerous burn-in cycles based on experimental testing of a motor used in the assemblies of FIG. 1 or 2.
Figure 6:
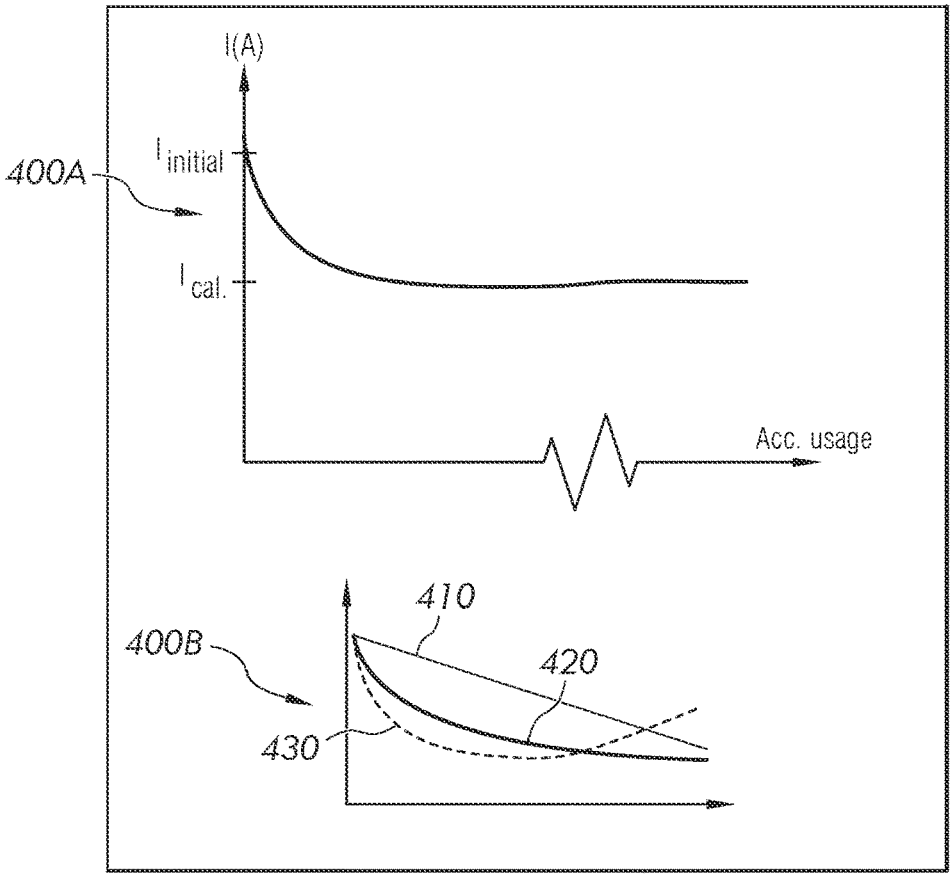
FIG. 6 schematically depicts a motor response pattern in the form of a compensation curve used to adjust the operation of a motor based on the efficiency and operating current usage changes of FIGS. 4 and 5.

Referring next to FIGS. 4 through 6 in conjunction with the table below, it can be seen that increases in time of use (that is to say, accumulated use) and temperature lead to measurable changes in motor 110 efficiency (FIG. 4) and current usage (FIG. 5).

| Eight motors during the first two seconds of operation @ 18 Nm | | | | | | | |
|---|---|---|---|---|---|---|---|
| Temp | Speed (rpm) | | | Current (amps) | | | Efficiency |
| (° C.) | Average | Max. | Min. | Average | Max | Min | (%) |
| 10 | 45.94 | 46.84 | 45.26 | 16.84 | 17.57 | 16.25 | 21.4 |
| 20 | 46.86 | 48.14 | 45.97 | 16.64 | 17.84 | 15.38 | 22.1 |
| 40 | 49.31 | 50.62 | 48.20 | 15.00 | 15.82 | 13.86 | 25.8 |

In particular, motor 110 speed rises as current use falls, both in conjunction with increases in motor 110 operating temperature. Both of these measurements provide indicia of changes in motor 110 efficiency. Likewise, the efficiency changes with motor 110 use time. Moreover, FIG. 4 shows that for a motor 110 under a constant load of 18 Nm that starts operating at 10° C., after about 2 seconds, its efficiency is about 21%, whereas after 30 to 40 seconds, the increase in operating temperature of the various components, lubricating grease or the like causes the efficiency to rise to over 35%. While this is but one example of changes in the operation of the motor 110 in response to temperature and accumulated use that is correlated to an adjustment threshold that would justify corrective action to be taken by the control unit 202, it will be appreciated that other examples—as well as other increments of changes within motor 110 operational efficiency where such an adjustment threshold is met—are likewise within the scope of the present disclosure. As mentioned previously, values corresponding to such adjustment thresholds may be stored in algorithmic or database form, the latter in lookup tables that may be embodied in memory that cooperates with (or is formed as part of) control unit 202.

Referring with particularity to FIG. 5, burn-in (also referred to herein as wear-in) impact on motor 110 characteristics is shown. In general, the figure shows that the operating current tends to decrease with increases in accumulated usage. In particular, six tests T1, T2, T3, T4, T5 and T6 were conducted, where each corresponds to different motors 110 that were each used to lift the same load six different times. The data shows that, for each motor 110, there is a change in efficiency with increased use that provides indicia of accumulated usage. The data also shows that the change in efficiency for each motor 110 roughly follows the same trend and converge to the same value. In the tests T1, T2, T3, T4, T5 and T6, the motor 110 was cooled down to the same temperature between each test. As shown, the motor 110 on the first run (that corresponds to the top line) initially draws over 30 amperes, yet after running for the sixth test T6 only requires a current draw of fewer than 20 amperes to lift the same load as in the first test T1. This reduction in current over time can be correlated to a rise in efficiency. Likewise, the same motor (cooled down) will after numerous runs shows an initial current draw value (that corresponds to the bottom line) of just over 27 amperes, along with a final current draw of just below 20 amperes. Thus, even in circumstances where the as-manufactured motor 110 initially has a difference of approximately 3 amperes (i.e., about 10%), such difference tends to substantially disappear after numerous runs that are attributable to a burn-in or wear-in factor. Significantly, the electronic control unit 202 is further equipped to analyze accumulated usage factors such as this to determine (as well as adjust, when the adjustment threshold corresponding to a deviation in such current use requirements is met) the amount of electrical current needed by the motor 110 in order to perform its lifting or lowering function for a given amount of weight.

Regarding temperature, at higher operating temperatures, motor 110 exhibits improved levels of efficiency, due in part to the lower resistance attendant to a warmer medium through which the current flows, as well as possible improvements in carbon brush conductivity (this latter case for configurations where brushed motors are employed). Although not shown in FIG. 5, the same motor 110 will experience a reduction in current consumption over time that is attributable to a temperature factor. For motor 110 configured in the patient lift assemblies 100, 300 of FIGS. 1 and 2, efficiencies under cold (i.e., room-temperature) and as-manufactured conditions corresponds to an efficiency of just over 20%, whereas when the temperature and wear-in increases, the efficiency goes above 35%. Of course, temperatures cannot be increased too much to the point where either damage occurs in certain lift unit components (for example, worm-gears) or where such elevated temperatures may adversely impact the ability of motor 110 self-locking. In one example, it is preferable to limit outside motor 110 temperatures to no more than about 65 degrees Celsius. As will be appreciated, the differences between a cold and warm motor 110 that ordinarily might not be noteworthy in situations where the motor 110 is continuously running should preferably be taken into consideration in configurations (such as with the patient lifting assemblies 100, 300 disclosed herein) where the motor 110 experiences numerous cold stops and starts over its lifetime.

The current-versus accumulated usage and temperature values stored in the lookup table or algorithm can be used to adjust the maximum current limit when certain thresholds are exceeded. Within the present context, in one form such adjustment threshold may be made as small as possible such that substantially any difference or deviation between the collected parameter data associated with actual motor 110 operation differs from the corresponding reference values. Likewise, in another form such adjustment threshold may be made in predefined increments such that the maximum current limit is adjusted only if the difference or deviation between the collected parameter data associated with actual motor 110 operation differs from the corresponding reference values exceeds the predefined increment. It will be appreciated that both such variants of adjustment threshold are within the scope of the present disclosure. Motor 110 temperature measurements may be made either directly—such as through one or more of the aforementioned sensors 203A-G that may be mounted on or near certain indicative components (such as rotor, stator, bearings or the like, none of which are shown)—or indirectly, such as through the use of a resistive measurement. In addition to the current-measuring sensors 203E, temperature-measuring sensors 203F and geometrical sensors 203G may interact with electronic control unit 202 in order to provide changes to operation of motor 110. For example, in the period that corresponds to the routine operation of motor 110, the selective application of temperature-related adjustments may be used that are based on changes in motor 110 efficiency based on particular temperature regimes. This may involve temperature measurements taken inside of the motor 110, as well as outside the motor 110. Geometrical sensors can provide an impact of motor 110 geometry, such as those associated with forces applied between the actuator arm 114 and the lift arm 106 in the mobile person lifting assembly 100, or the torque on the lift strap drum and the force on the lift strap in the overhead person lifting assembly 300.

Referring with particularity to FIG. 6, a pair of compensation curves 400A, 400B show, respectively, general changes in current usage by motor 110 with increases in accumulated usage and more specifically three models for changes in operating current usage. Traditionally, in order to reach stable operating levels, it was deemed necessary to perform break-in or wear-in operations in order to ensure the motor would operate at its designed setting. Using the aforementioned lookup table as an example, if a weight of 200 kilograms (i.e., 440 pounds) correlates within the table to a nominal 7 amps of current as an as-designed condition of motor 110, the same weight may require a smaller amount of current in situations where the motor 110 has already experienced some sort of break-in period. As such, the accumulated wear (whether measured by one or both of operational hours or number of cold starts) provide indicia of how such wear impacts the amount of operating current needed by the motor 110 in order to lift a particular load. Referring with particularity to the second compensation curve 400B, three separate patterns for changes in operating current assumptions emerge. The first pattern 410 shows a straight linear assumption, while the second pattern 420 shows an initial exponential decline assumption where a relative flattening occurs after a few (for example, about ten) cycles. A third pattern 430 is somewhat similar to the second except near the motor 110 EOL, significant reductions in efficiency can be expected; this last pattern 430 defines what is known as a bathtub shape, in that for a constant weight or related load, early in life, the motor 110 experiences an approximate exponentially-decreasing amount of required operating current as the accumulated use goes up in a period that generally coincides with motor 110 break-in or wear-in, then generally flattens out over a significant portion of accumulated use of the motor 110, only to have the operating current needs rise near the end of motor 110 life as certain components (for example, bearings, brushes or related items that are exposed to mechanical interactions and concomitant levels of friction) become worn.

As mentioned in conjunction with FIG. 3 above, information pertaining to a motor operating current response pattern is embodied in the compensation curve of FIG. 6 as a lookup table or related data structure so that for a given amount of accumulated use (whether measured in hours, ampere-hours, number of cold starts or other measure of motor 110 wear, or the like), the table provides a corresponding adjustment of the maximum current limit for motor 110 for such level of accumulated use relative to its as-manufactured condition. Likewise, and in a manner generally similar to that of the temperature adjustments discussed above, an equation-based approach may be taken to quantify the effects of one of the three representations 410, 420 and 430 on the maximum current limit of the motor 110.

Regardless of how the wear compensation data is acted upon by control unit 202, with this knowledge it is possible to compensate for wear of the motor 110 and other parts of the assemblies 100, 300. Much of this reflects the belief by the present authors that electric motors such as those used in lift systems as discussed in the present disclosure exhibit an early wear-in period before reaching a stable current level. Thus, a new motor will change its characteristics over time and attain a stable level. As such, the second and third representations 420, 430 reflect a more accurate representation of changes in motor 110 efficiency over time than the straight linear representation 410, where the reduction in current needs exhibits a constant downward trend. Through the approach discussed in this present disclosure, as the motor 110 experiences increased usage (as shown progressing rightward along the x-axis in the figure), through at least a portion of its accumulated life, it will require smaller amounts of current (as shown along the y-axis) up to a point that coincides with its established break-in period. In one example, such plateauing of the second and third representations 420, 430 may take place after a certain number of cold starts or hours of operating time. In one example, about ten cycle times are used with approximately 0.5 meters of lifting height, where an estimated operating time of about 1 minute/cycle with an overall burn-in time of about ten minutes is employed.

Of the second and third representations 420, 430, the present authors are of the belief that that the third—by virtue of it including late-in-life reductions in efficiency as a result of wear to gear, bearing and related components—more accurately reflects the true current needs of the motor 110 over its working life; the combination of the left- and right-side increases in current give representation 430 what is colloquially referred to as a bathtub shape curve.

Figure 7:
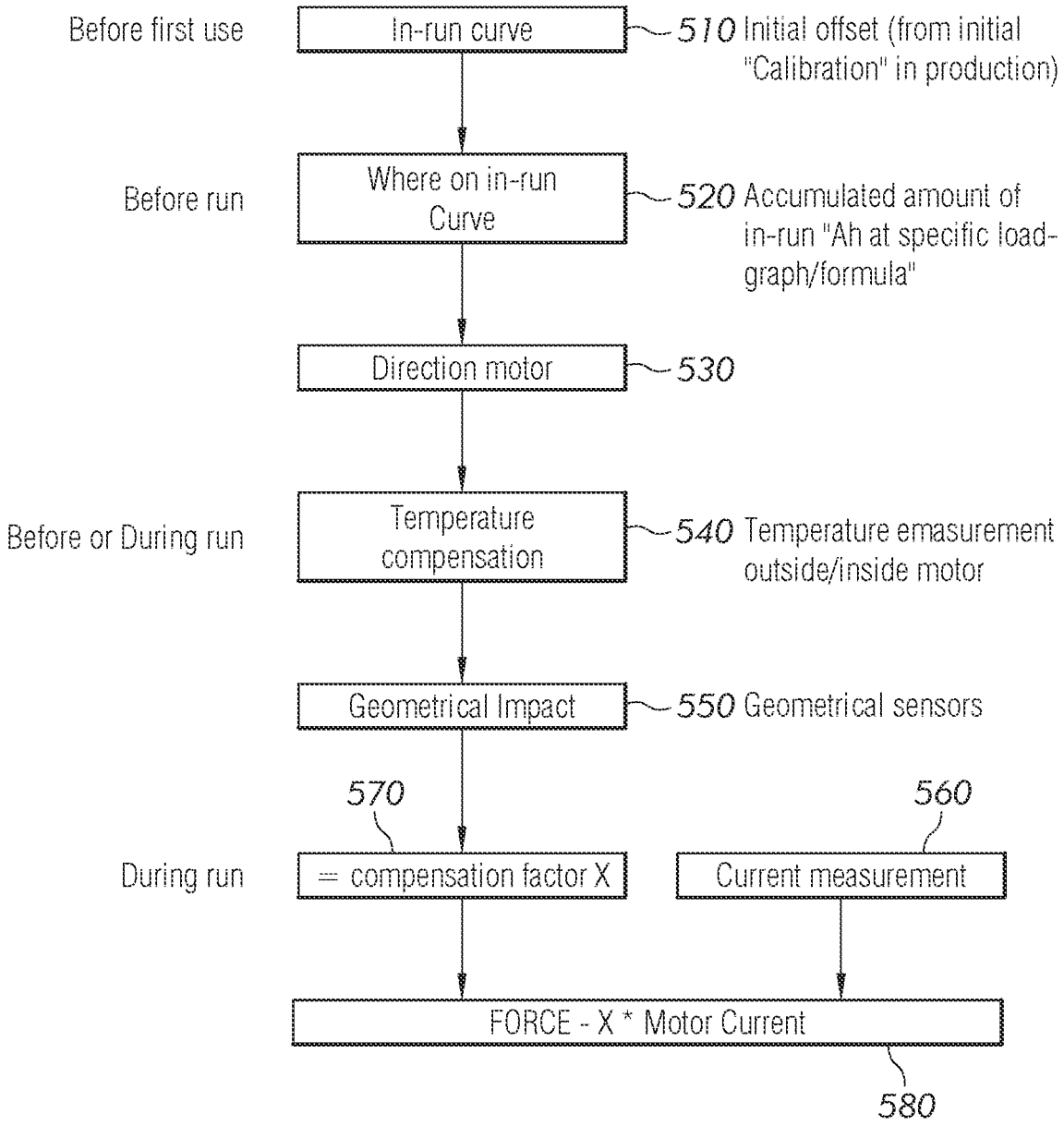
FIG. 7 schematically depicts a flowchart of embodiments of how to adjust motor operation based on changes in sensed temperature and wear parameters according to the present disclosure.

Referring next to FIG. 7, a flow diagram 500 shows the steps of how one or both of the temperature or accumulated use compensation that make up the operational parameter would interact with the control unit 202 in order to adjust the current limit for the motor 110 to take into consideration variations in motor 110 operating temperature or accumulated use, as well as those that impact the load in the manner generalized in Eqn. (1) as discussed previously. This compensation allows for knowledge of such characteristics to help to more closely correlate actual motor 110 current needs to a given load; this can be important to ensure the motor 110 is not able to exceed lift margins (such as, for example and without limitation, more than 1.5 times the maximum rated load) consistent with the current limits that correlate to the maximum load rating for the person lifting assemblies 100, 300. Furthermore, by correlating current usage to person weight or other related load that needs to be operated on by the motor 110, the motive system disclosed herein may avoid the use of redundant equipment, such as load cells or related weight-measuring apparatus.

In particular, the flow diagram 500 shows steps associated with mapping accumulated usage and temperature data, as well as those leading to forming one or more suitable compensation factors that may subsequently be used by the control unit 202 to determine if an adjustment threshold that indicates that a correlation between the as-manufactured work required and an actual work required is no longer present during operation of the motor has been met. In a period before first use 510, an in-run curve is generated to provide the initial offset that may be taken from the initial calibration of the as-produced motor 110. Thus, given the as-produced motor 110, the changes in efficiency can be determined once a statistically-significant database of numerous motor 110 burn-in runs have been collected; such database may be included in either algorithmic or lookup table form that may be used by electronic control unit 202 of FIG. 3. In one form, in the period before routine operation 520, an accumulated amount of motor 110 in-run at a specific load is mapped. As stated above in conjunction with the lookup table and equations, such information may be generated graphically or via formula. This mapping can be in the form of specific amp-hour compensation parameters. In addition, the direction of motor step 530 may be used to take into consideration differences based on whether the motor 110 is being operated in a person lifting or a person lowering direction of movement, as person lowering involves a lower amount of current usage.

Once the accumulated usage parameters have been generated, temperature-related compensation parameters can be acquired in step 540. In one form, temperature measurements (such as from thermometers, thermocouples or related sensors 203F) may be taken in or around one or more locations within motor 110. In addition, such measurements may be taken under varying loads, where higher loads correspond to higher current use and concomitant increases in temperature. Additional measurement from geometric sensors 203G in step 550 may be taken to determine the impact of both the amount and placement of loads on the various components of the person lifting assemblies 100, 300 described herein. Furthermore, current measurements by sensors 203E as shown in step 560 may be used in conjunction with a compensation factor X that is derived from the values taken from the geometrical sensors 203G to determine the impact of motor 110 configuration. Thereafter, the accumulated use compensation parameters from steps 510 through 530 and the temperature-related compensation parameters from step 540 and the geometric parameters of step 550 are used to formulate an overall compensation factor 570 during normal motor 110 operation. As shown in step 580, the overall compensation factor 570 is used to adjust—either upwardly in the case of decreases in efficiency associated with motor 110 EOL and downwardly in the case of increases in efficiency associated with varying degrees of increases in one or both of motor 110 temperature and accumulated usage—the current limit that is permitted to be delivered to motor 110.

Once the parameters used to provide a compensation factor X of a sample motor 110 are generated, measurement and selective adjustment of a maximum current limit for a particular motor 110 operating with a particular load may commence. In particular, the measured and stored parameters that were collected during the mapping steps associated with flow diagram 500 are stored in memory of the control unit 202. These parameters are then compared to instant motor 110 operating conditions (such as by measurements taken by one or more sensors that are shown generally in FIG. 3 as 203) to predict how much of an adjustment to the amount of work (and therefore electric current) will be required for a given motor 110 operation. Thus, after a determination is made by the control unit 202 that the load on the corresponding patient lifting assembly 100, 300 won't exceed the maximum load rating, the control unit 202 may instruct the motor 110 to perform a patient moving operation, thereby causing the motor 110 to start consuming electric current. Significantly, the control unit 202 adjusts the maximum current limit based on the differences in the operational parameter (or parameters) associated with the compensation factor X such that the operating current cannot exceed values associated with one or both of the temperature and accumulated usage that are based on the instant patient lifting or moving operation. Significantly, the adjustment threshold provides indicia of a lack of correlation between the operating current of the as-manufactured motor and the operating current of the motor 110 in the instant operating condition, while the compensation factor X provides an amount of adjustment in the current limit available to such motor 110 during such instant operating condition. Thus, in the event that the adjustment threshold is met, the control unit 202 adjusts a maximum current limit available to the motor 110. Lastly, the motor 110 may be stopped in the event that a maximum load rating of one or more of the components making up the patient lift assemblies 100, 300 is exceeded. In one form, the control unit 202 may perform an iterative, loop-based process by comparing operational parameters collected through the sensors 203 with the stored parameters so that for each iteration of the lifting step, the control unit 202 may determine if the maximum current limit needs to be further adjusted, and take suitable action, if necessary.

Measured or related acquired data may be used in algorithmic or lookup table formats for subsequent or concurrent use by electronic control unit 202 as a way to operate the person lifting assemblies 100, 300 that are described herein. In particular, the algorithm or lookup table uses the measured values for comparison as a way to determine whether the adjustment threshold has been met and if so, to adjust the maximum current limit that corresponds to the maximum load rating of the motor 110 to prevent a load greater than the maximum load rating from being lifted. For example, in the case of a mobile lift such as the person lifting assembly 100 schematically depicted in FIG. 1, the person lifting assembly 100 may be positioned proximate a bed, chair or related patient support. Thereafter, the amount of electrical current needed to lift the person is measured or otherwise collected, while acquired motor 110 operating temperature and accumulated use parameters may be compared to reference values. If data for either or both of these sensed parameters is within an adjustment threshold, then appropriate adjustment or compensation may be applied by the control unit 202 to modify the maximum current limit for current delivered to the motor 110 so that a real-time adaptive compensation is provided. A feedback loop (not shown) may also be provided to help promote attainment of the desired level of current. Regardless of whether the reference values that take into consideration correction (that is to say, compensation) factors to the as-manufactured motor 110 parameters are stored in a lookup table or as part of an equation, the automatic operation of the electronic control unit 202 provides selective adjustment of the maximum current limit of the motor 110 when at least one of the compared temperature and compared accumulated use data is within such adjustment threshold. This in turn ensures that the person lifting assemblies 100, 300 operate without exceeding their maximum working load while still operating efficiently to lift loads within their maximum working load (that is to say, to lift a load up to the maximum working load of the person lifting assemblies 100, 300 without premature shutdown). Moreover, as shown by the bathtub shaped curve 430 of FIG. 6, reductions in efficiency of motor 110 as the accumulated use approaches EOL of person lifting assemblies 100, 300 may be compensated for by upwardly adjusting the maximum current limit as the motor 110 efficiency decreases. In particular, as the efficiency of the motor 110 begins to degrade, the maximum current limit can be upwardly adjusted to insure that the person lifting assemblies 100, 300 are still able to lift up to their maximum working load without the control unit 202 forcing a system shutdown.

The control unit 202 may be programmed to prevent operation of the person lifting assemblies 100, 300 when one or more of a sensed weight, actual current flow, accumulated use or other indicia of assembly 100, 300 performance is outside of a predetermined range. In these embodiments, the person lifting assemblies 100, 300 may further include one or more accessory sensors 260 which are communicatively coupled to the electronic control unit 202, either by wire or wirelessly. In embodiments, the accessory sensors 260 may be located in the accessory coupling, such as a sling bar. For example, in the embodiments of the person lifting assembly 100 shown in FIG. 1 and the person lifting assembly 300 shown in FIG. 2, the accessory sensors 260 are located in the lift accessory 136.

Importantly, the systems, assemblies and methods disclosed herein are a useful way to anticipate changes in motor 110 characteristics, as well as how to adjust or otherwise compensate for such changes. As such, the control over motor 110 operation as disclosed herein will (a) reduce as-manufactured motor 110 burn-in- or wear-in time and as a result, save time and money as such control will help tailor motor 110 operational efficiency changes that occur over time and use to actual current use needs that correspond to a particular maximum load; (b) promote efficient operation over the life of the patient lifting assembly 100, as well as promote regulatory compliance (for example, in situations where a motor is not permitted to lift more than 1.5 times its maximum rated load); (c) generate additional operational data in order to further optimize motor 110 characteristics; and (d) help correlate differences between input power (electrical power, such as from on-board batteries) and output power (work) to provide accurate estimates of the weight being lifted, such that separate weight-measuring devices (such as load cells or the like) can be done away with as redundant.

Based on the foregoing, it should be understood that the person lifting assemblies 100, 300 described herein include electronic control units 202 which may be used to vary the maximum current limit of the motor 110 based on changes in motor 110 temperature, accumulated motor usage or both. The collected sensory data is analyzed by the control unit 202 to determine a characteristic of these operating parameters, as well as to provide a suitable control signal to the motor 110 to adjust the maximum current limit of the motor and thereby ensure that the person lifting assemblies are lifting loads up to their maximum load rating without exceeding their maximum load rating.

It is noted that terms like "preferably", "generally" and "typically" are not utilized herein to limit the scope of the claims or to imply that certain features are critical, essential, or even important to the structures or functions disclosed herein. Rather, these terms are merely intended to highlight alternative or additional features that may or may not be utilized in a particular embodiment of the disclosed subject matter. Likewise, it is noted that the terms "substantially" and "approximately" and their variants are utilized herein to represent the inherent degree of uncertainty that may be attributed to any quantitative comparison, value, measurement or other representation. As such, use of these terms represent the degree by which a quantitative representation may vary from a stated reference without resulting in a change in the basic function of the subject matter at issue.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A motive system for a patient lifting assembly, the system comprising:
- a motor;
- a plurality of sensors comprising at least a temperature sensor, a current sensor and an accumulated use sensor; and
- an adaptive control unit signally cooperative with the motor and the sensors, the control unit comprising a processor and a non-transient memory storing a computer readable and executable instruction set which, when executed by the processor:
  - collects data from the sensors during operation of the motor;
  - compares at least one of (a) the collected temperature data to a reference motor temperature value stored in the memory and (b) the collected accumulated use data to a reference accumulated use value stored in the memory that corresponds to at least one of (i) a number of motor starts and (ii) a length of time the motor has been in operation; and
  - provides selective adjustment of a maximum current limit of the motor during a period of operation thereof when at least one of the collected temperature and collected accumulated use data differs from the corresponding reference motor temperature value and reference accumulated use value.

2. The motive system of claim 1, wherein the motor comprises a brushed DC motor.

3. The motive system of claim 1, wherein the adjustment threshold for the compared temperature data is between about ten degrees Celsius and about seventy degrees Celsius.

4. The motive system of claim 1, wherein the temperature sensor measures an internal operational temperature of the motor.

5. The motive system of claim 1, wherein the temperature sensor measures an external operational temperature of the motor.

6. The motive system of claim 1, wherein the reference current, temperature and accumulated use values that are stored in the memory comprise respective lookup tables that each correlate the values measured by the corresponding sensor to the maximum current limit for operating the motor.

7. The motive system of claim 6, wherein the maximum current limit versus the accumulated use value within the table is defined by a pattern selected from the group consisting of an exponentially decreasing correlation and a bathtub-shaped correlation.

8. The motive system of claim 7, wherein the bathtub-shaped correlation corresponds to decreases in current draw needs by the motor over at least an initial portion of an expected lifetime of the motor and increases in current draw needs by the motor over at least an end-of-life portion of the expected lifetime of the motor.

9. The motive system of claim 1, wherein the computer readable and executable instruction set, when executed by the processor, adjusts the maximum current limit available to the motor based on a motor response pattern selected from the group consisting of an exponentially decreasing correlation and a bathtub-shaped correlation.

10. The motive system of claim 1, wherein the computer readable and executable instruction set that executed by the processor compares both the collected temperature data and the collected accumulated use data to corresponding reference motor temperature and accumulated use values.

11. A patient lifting assembly comprising:
- a base;
- at least one actuator; and
- a motive system coupled to the base and the at least one actuator, the motive system comprising:
  - a motor configured to provide motive power to the at least one actuator;

a plurality of sensors comprising at least a temperature sensor, a current sensor and an accumulated use sensor; and an adaptive control unit signally cooperative with the motor and the sensors, the control unit comprising a processor and a non-transient memory storing a computer readable and executable instruction set which, when executed by the processor:

collects data from the sensors during operation of the motor;

compares at least one of (a) the collected temperature data to a reference motor temperature value stored in the memory and (b) the collected accumulated use data to a reference accumulated use value stored in the memory that corresponds to at least one of (i) a number of motor starts and (ii) a length of time the motor has been in operation; and provides selective adjustment of a maximum current limit of the motor during a period of operation thereof when at least one of the collected temperature and collected accumulated use data differs from the corresponding reference motor temperature value and reference accumulated use value.

12. The patient lifting assembly of claim 11, wherein the base comprises a stationary overhead rail and the at least one actuator comprises (a) a carriage configured to move the motive system along the rail, and (b) a lifting strap movably responsive to operation of the motor.

13. The patient lifting assembly of claim 11, wherein the base comprises a wheeled mobile frame and the at least one actuator comprises at least one arm responsive to operation of the motor.

14. A method for operating a patient lifting assembly, the method comprising:

moving a patient that is disposed within the patient lifting assembly through the operation of an electric motor that provides motive power thereto;

determining an operational parameter comprising at least one of a motor temperature and a motor accumulated usage;

comparing the operational parameter to a corresponding reference value to determine whether a difference exists; and adjusting a maximum current limit of the motor during a period of operation thereof based on the difference.

15. The method of claim 14, wherein the adjusting is based on collecting data from at least one of a plurality of sensors during operation of the motor.

16. The method of claim 15, wherein the adjusting is based on operation of a control unit signally coupled to the motor and the at least one of a plurality of sensors, wherein the control unit comprises a processor and a non-transient memory storing a computer readable and executable instruction set that comprises the reference value.

17. The method of claim 16, wherein the computer readable and executable instruction set, when executed by the processor, reduces the maximum current limit available to the motor based on a motor response pattern selected from the group consisting of an exponentially decreasing correlation and a bathtub-shaped correlation.

18. The method of claim 15, wherein at least one of the plurality of sensors comprises a temperature sensor that measures an internal operational temperature of the motor.

19. The method of claim 15, wherein at least one of the plurality of sensors comprises a temperature sensor that measures an external operational temperature of the motor.

20. The method of claim 14, wherein the motor comprises a brushed DC motor.

21. The method of claim 14, wherein the difference for the temperature of the motor is between about ten degrees Celsius and about seventy degrees Celsius.

22. The method of claim 14, wherein the reference current, temperature and accumulated use values that are stored in the memory comprise respective lookup tables.

23. The method of claim 22, wherein changes in operating current versus the accumulated use value within the table is defined by a pattern selected from the group consisting of an exponentially decreasing correlation and a bathtub-shaped correlation.

24. The method of claim 23, wherein the bathtub-shaped correlation corresponds to decreases in operating current needs by the motor over at least an initial portion of an expected lifetime of the motor and increases in operating current needs by the motor over at least an end-of-life portion of the expected lifetime of the motor.

25. The method of claim 14, wherein the determining at least one operational parameter of an accumulated usage comprises at least one of a total number of motor starts and a total length of time the motor has been in operation.

* * * * *